US006869198B1

(12) United States Patent
Garza

(10) Patent No.: US 6,869,198 B1
(45) Date of Patent: Mar. 22, 2005

(54) PORTABLE PALM TREE IN A PLANTER

(76) Inventor: Saul Garza, 4518 Rhoda La., Needville, TX (US) 77461

( * ) Notice: Subject to any disclaimer, the term of this patent is extended or adjusted under 35 U.S.C. 154(b) by 0 days.

(21) Appl. No.: 10/797,049

(22) Filed: Mar. 11, 2004

(51) Int. Cl.[7] ..... F21S 6/00
(52) U.S. Cl. ..... 362/123; 362/122
(58) Field of Search ..... 362/122, 123, 362/249, 252, 396, 399, 806; 428/17, 18, 428/19, 20; 47/47, 66.6, 67

(56) References Cited

U.S. PATENT DOCUMENTS

| | | | | | |
|---|---|---|---|---|---|
| 2,259,227 | A | * | 10/1941 | Peroni | 428/18 |
| 3,144,375 | A | * | 8/1964 | Day | 428/18 |
| 4,634,613 | A | * | 1/1987 | Potter | 428/20 |
| D309,639 | S | | 7/1990 | Knudsen | D21/108 |
| 5,085,900 | A | | 2/1992 | Hamlett | 428/18 |
| 5,091,227 | A | | 2/1992 | Wright et al. | 428/18 |
| D340,003 | S | | 10/1993 | Wright et al. | D11/118 |
| 5,340,622 | A | | 8/1994 | Curitti | 428/18 |
| 5,762,311 | A | * | 6/1998 | Triglia | 362/123 |
| 5,984,489 | A | * | 11/1999 | Rubenstein | 362/123 |
| 6,030,670 | A | * | 2/2000 | Chang | 428/19 |
| 6,286,266 | B1 | | 9/2001 | Popowych et al. | 52/40 |
| 6,402,341 | B1 | * | 6/2002 | Onate | 362/249 |
| 6,596,353 | B1 | | 7/2003 | Turner | 428/18 |
| 6,599,591 | B1 | | 7/2003 | Scott | 428/18 |
| 2003/0235054 | A1 | * | 12/2003 | Ruggles | 362/122 |

* cited by examiner

*Primary Examiner*—Y. My Quach-Lee
(74) *Attorney, Agent, or Firm*—Richard C. Litman

(57) ABSTRACT

A portable palm tree in a planter. The tree has a core stem with a proximal end and a distal end to provide structure for the portable palm tree in a planter, a planter box to receive and hold the core stem in an upright position, a plurality of sheet metal leaves each with a threaded stem attached to the core stem, a base disposed within the bottom of the planter box with a flange to receive the proximal end of the core stem, and a plurality of artificial coconut lights to illuminate the portable palm tree in a planter. Different embodiments have different placements for the plurality of artificial coconut lights.

19 Claims, 8 Drawing Sheets

PORTABLE PALM TREE IN A PLANTER

BACKGROUND OF THE INVENTION

1. Field of the Invention

The present invention relates to decorative artificial trees and, more particularly, to a portable artificial palm tree in a planter.

2. Description of the Related Art

Artificial trees and plants are a convenient and easy way to decorate and brighten an office or home. These trees and plants require less maintenance and upkeep than real trees and plants. Many artificial trees and plants have appear so realistic that it is difficult to tell the difference between them and real trees and plants.

Various artificial trees and plants are found in the related art.

U.S. Pat. No. Des. 309,639 issued to Knudsen on Jul. 31, 1990, outlines an ornamental design for a toy palm tree.

U.S. Pat. No. Des. 340,003 issued to Wright et al. on Oct. 5, 1993, outlines an ornamental design for an artificial palm tree.

U.S. Pat. No. 3,144,375 issued to Day on Aug. 11, 1964, outlines the use of a unique artificial tree which may be used outdoors for beautifying and landscaping home and estate lawns and yards, boulevard margins and center parkways, public park grounds and areas where natural trees are customarily used and which are equally well adapted for indoor decorative use wherever and whenever desired.

U.S. Pat. No. 5,085,900 issued to Hamlett on Feb. 4, 1992, outlines the use of an artificial palm tree with a trunk having a cylindrically-shaped axial cavity, a cylindrically-shaped cap having a plurality of cylindrically-shaped ferrules rigidly secured to the outer cylindrical surface of the cap such that the axis of each of the ferrules is aligned with the axis of the cap, a plurality of fronds and a support tube.

U.S. Pat. No. 5,091,227 issued to Wright et al. on Feb. 25, 1992, outlines the use of a decorative tree structure with a cluster of leaves, which are easily removed when pulled straight up and are difficult to remove when pulled from the side. The tree structure is safe, durable, easily assembled and disassembled and is particularly adapted to blend in with the furniture of the room in which it is placed.

U.S. Pat. No. 5,340,622 issued to Curitti on Aug. 23, 1994, outlines the use of an artificial tree for interior or exterior use capable of being formed in a variety of configurations simulative of a natural palm tree. The artificial tree has a body with one or more branch segments joined thereto, a plurality of leaf assemblies joined to each branch segment and a base for retaining ballast material capable of supporting the tree in an upright orientation.

U.S. Pat. No. 6,286,266 issued to Popowych et al. on Sep. 11, 2001, outlines the use of a modified monopole tower with a galvanized steel truncated pyramidal monopole capped by a cellular phone apparatus. The monopole head is ringed by three coronae of steel female receptors, which are welded to the pyramidal head of the tower with artificial palm fronds attached to the receptors primarily by mechanical methods.

U.S. Pat. No. 6,596,353 issued to Turner on Jul. 22, 2003, outlines the use of an artificial palm tree having a base, a frame attached to and extending upwardly from the base, the frame having an upper end, a helically wound metal strap having a leaf scar indicating an edge and a multiplicity of heat fusion welds interconnecting the frame mounting edge of the helically wound metal strap and frame. There is also a concentrically mounted cylinder slip sleeve and slip pin joint interconnecting the proximal ends of rachis indicating shafts with the upper end of the frame.

U.S. Pat. No. 6,599,591 issued to Scott on Jul. 29, 2003, outlines the use of an artificial palm tree having a planar base, a central support, an exterior covering and a separable crown. The central support of the artificial palm tree has one end affixed to the planar base. There is also an exterior covering constructed around the central support that is removably affixed to a free end of the central support.

Although each of these patents outline the use of novel and unobvious devices, what is really needed is a realistic artificial palm plant and planter that has its own lights, is portable and can be anchored down at a particular location. Such a device would be well-received in the marketplace and would meet a current demand for the device.

None of the above inventions and patents, taken either singly or in combination, is seen to describe the instant invention as claimed. Thus a portable palm in a planter solving the aforementioned problems is desired.

SUMMARY OF THE INVENTION

The invention is a portable palm tree in a planter. The palm tree has a core stem with a proximal end and a distal end to provide structure for the portable palm tree in a planter, a planter box to receive and hold the core stem in an upright position, a plurality of sheet metal leaves each with a threaded stem attached to the core stem, a base disposed within the bottom of the planter box with a flange to receive the proximal end of the core stem, and a plurality of artificial coconut lights to illuminate the portable palm tree in a planter. Different embodiments have different placements for the plurality of artificial coconut lights.

Accordingly, it is a principal object of the invention to provide a realistic looking artificial palm tree and planter without the watering and maintenance of a real palm tree.

It is another object of the invention to provide a realistic looking artificial palm tree and planter that can be anchored to the floor or the ground.

It is a further object of the invention to provide a realistic looking artificial palm tree and planter with lights disposed in coconut shells that can be placed on the top of the artificial palm tree or at its base.

Still another object of the invention is to provide a realistic looking artificial palm tree and planter that can be easily transported.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
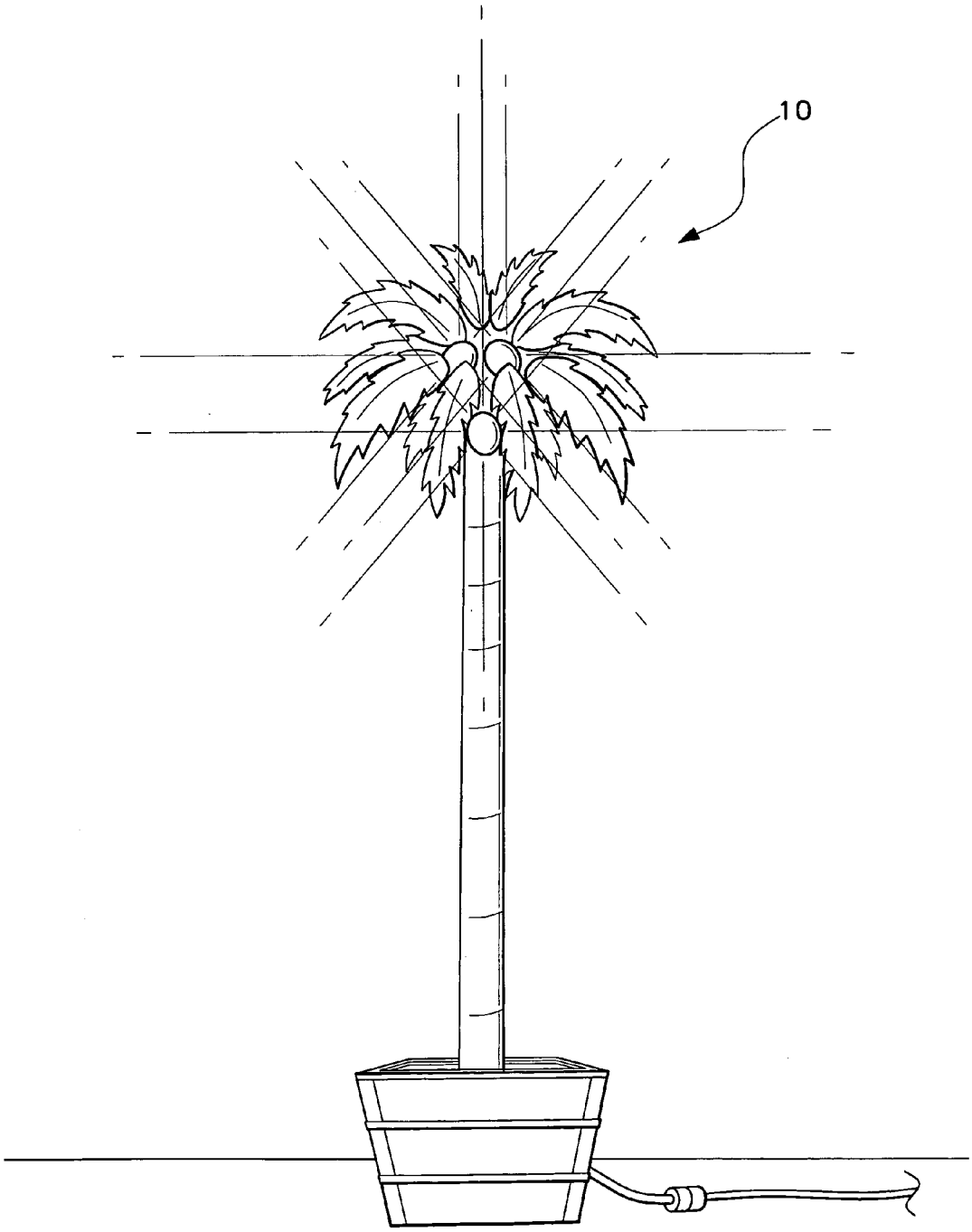
FIG. 1 is an environmental, perspective view of a portable palm tree in a planter according to the present invention.

The present invention is a portable palm tree in a planter 10, as is depicted in FIG. 1.

Figure 2A:
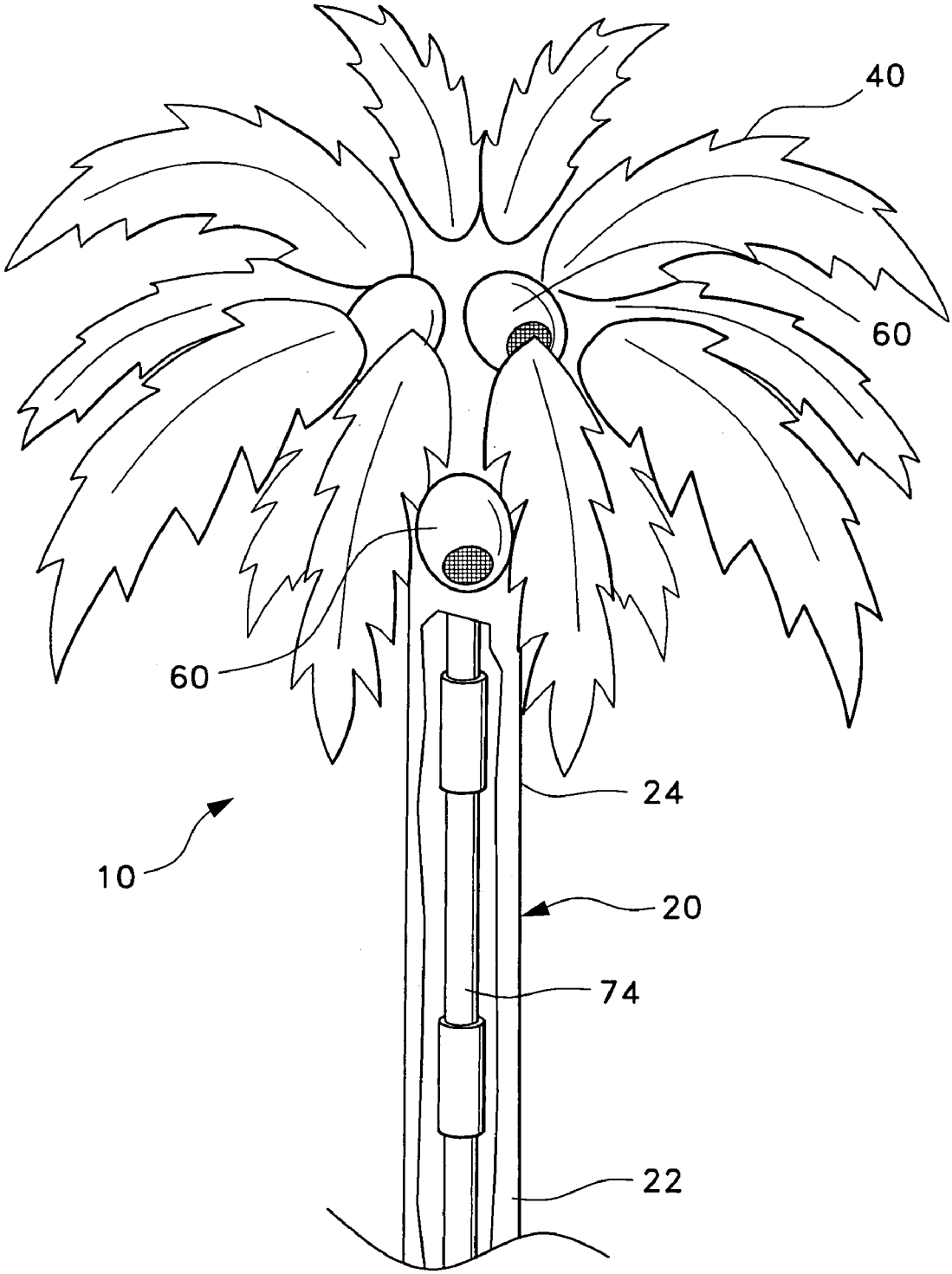
FIG. 2A and FIG. 2B are side perspective views of the portable palm tree in a planter.
Figure 2B:
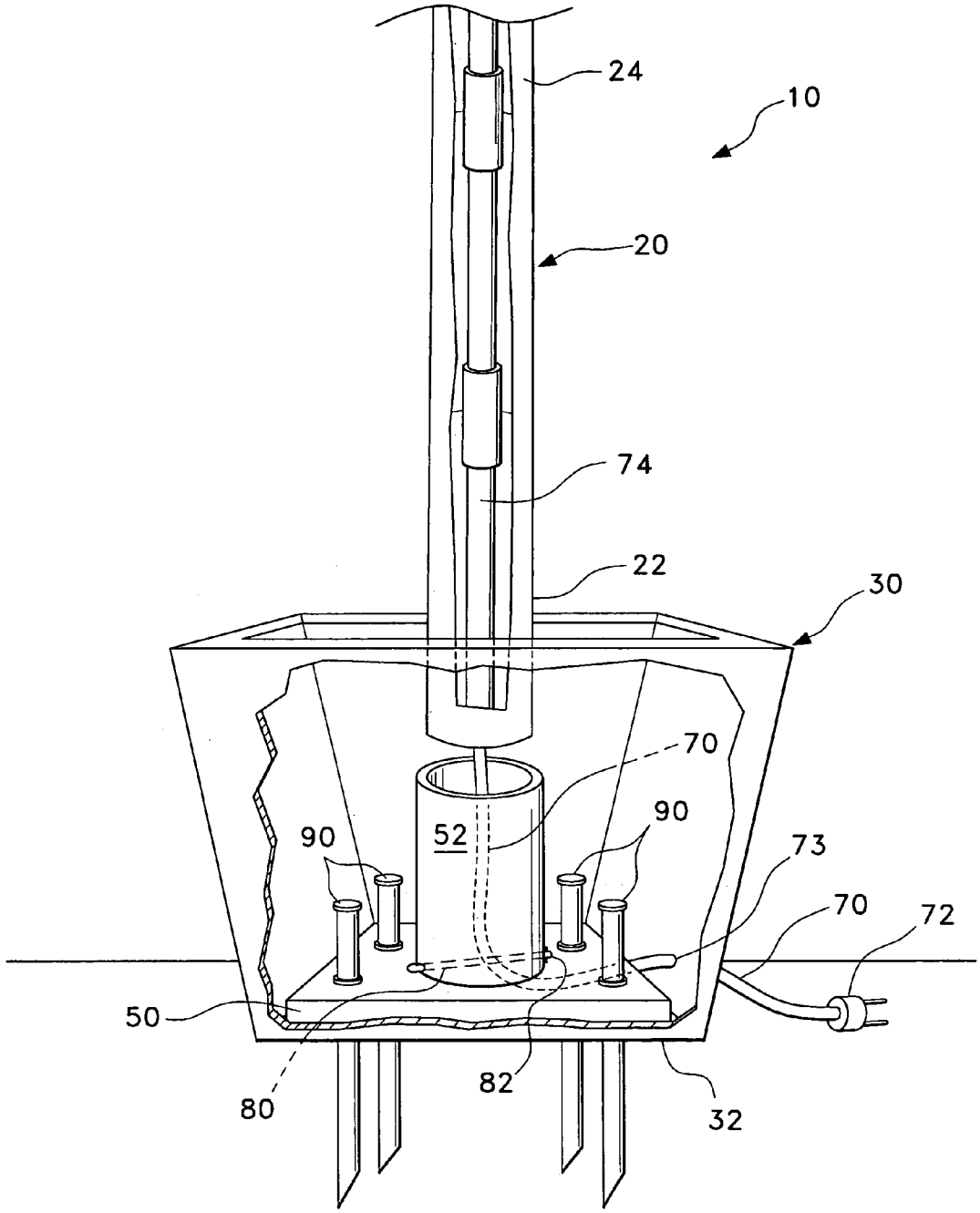

As is shown in FIG. 2A and FIG. 2B, the portable palm tree in a planter 10 comprises a core stem 20 with a proximal end 22 and a distal end 24 to provide structure for the portable palm tree in a planter 10, a planter box 30 with a bottom 32, to receive and hold the core stem 20 in an upright position and a plurality of sheet metal leaves 40 each with a threaded stem 42 (FIG. 4) attached to the core stem 20. The portable palm tree in a planter 10 further comprises a base 50 disposed within the bottom 32 of the planter box 30 with a flange 52 to receive the proximal end 22 of the core stem 20, a plurality of artificial coconut lights 60 to illuminate the portable palm tree in a planter 10 and an electrical cord 70 and plug 72 to provide power from a power source (not shown), to the plurality of coconut lights 60.

Note that the electrical cord 70 becomes conduit 74 once it is run up inside the core stem 20 to the plurality of coconut lights 60 of the first embodiment of the portable palm tree in a planter 10. The proximal end 22 of the core stem 20 is placed into the flange 52 of the base 50 and is secured with a metal drive bolt 80 and a cotter pin 82. The base 50 and the entire planter box 30 can also be anchored down and attached to the ground surface using 4 base corner anchors 90 disposed at each corner of the base 50. An aperture 73 is also provided in one of the sides of the planter box 30 to accommodate an electrical cord 70 running outside of the planter box 30.

Figure 3:
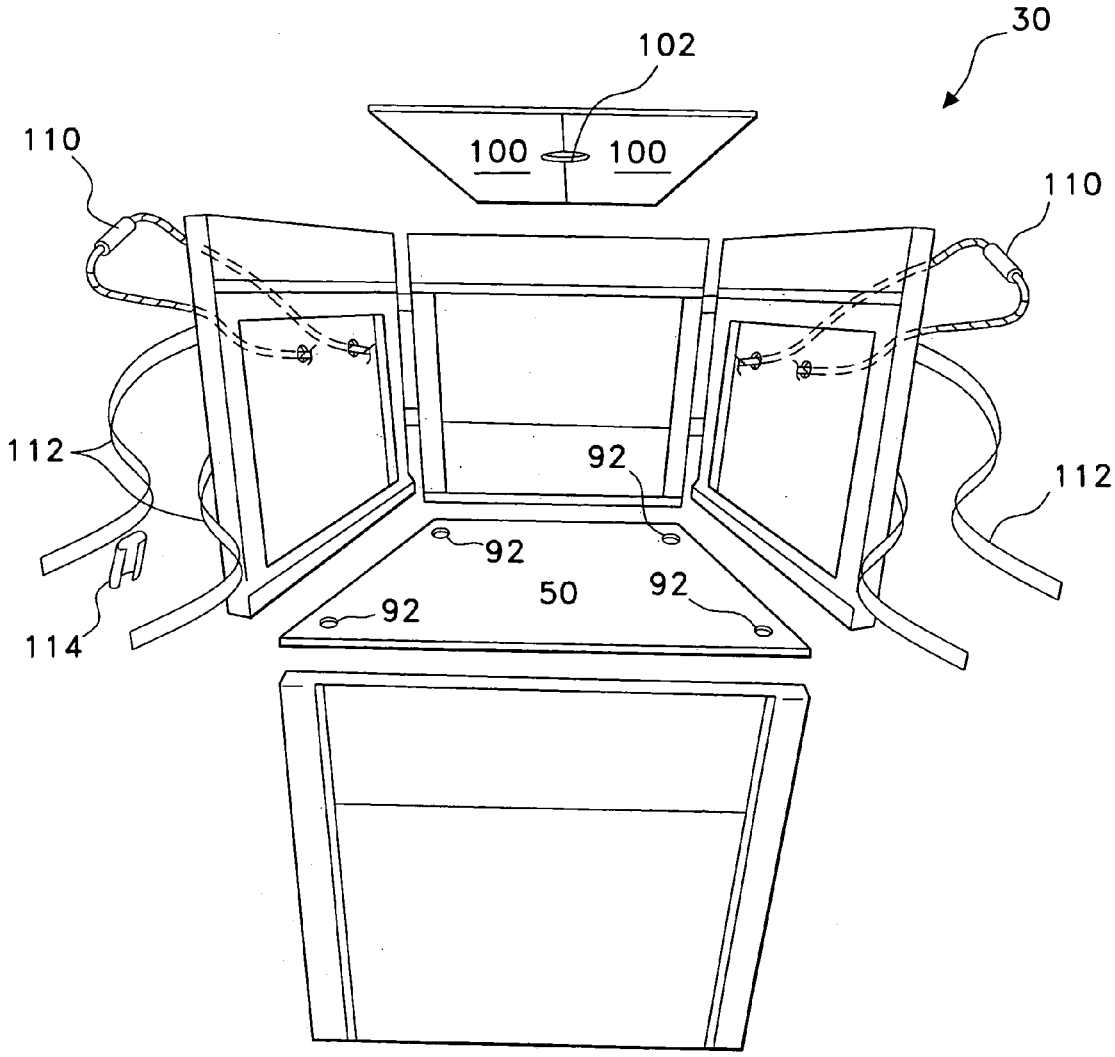
FIG. 3 is an exploded side perspective view of a planter box of the portable palm tree in a planter.

FIG. 3 depicts several other attributes and features of the planter box 30. Like the sides of the planter box 30, the core stem 20 is made of durable pressure treated wood. An aperture 102 is formed from the two top sections 100 coming together that can accommodate the core stem 20. The planter box 30 is provided with ropes and wooden handles 110 to make it easier to carry the planter box 30. The planter box 30 is also held together with a plurality of straps 112 and crimps 114 wrapped around the planter box 30. The base 50 also has apertures in each corner 92 to accommodate the base corner anchors 90 that are used to anchor down the base 50 and the planter box 30.

Figure 4A:
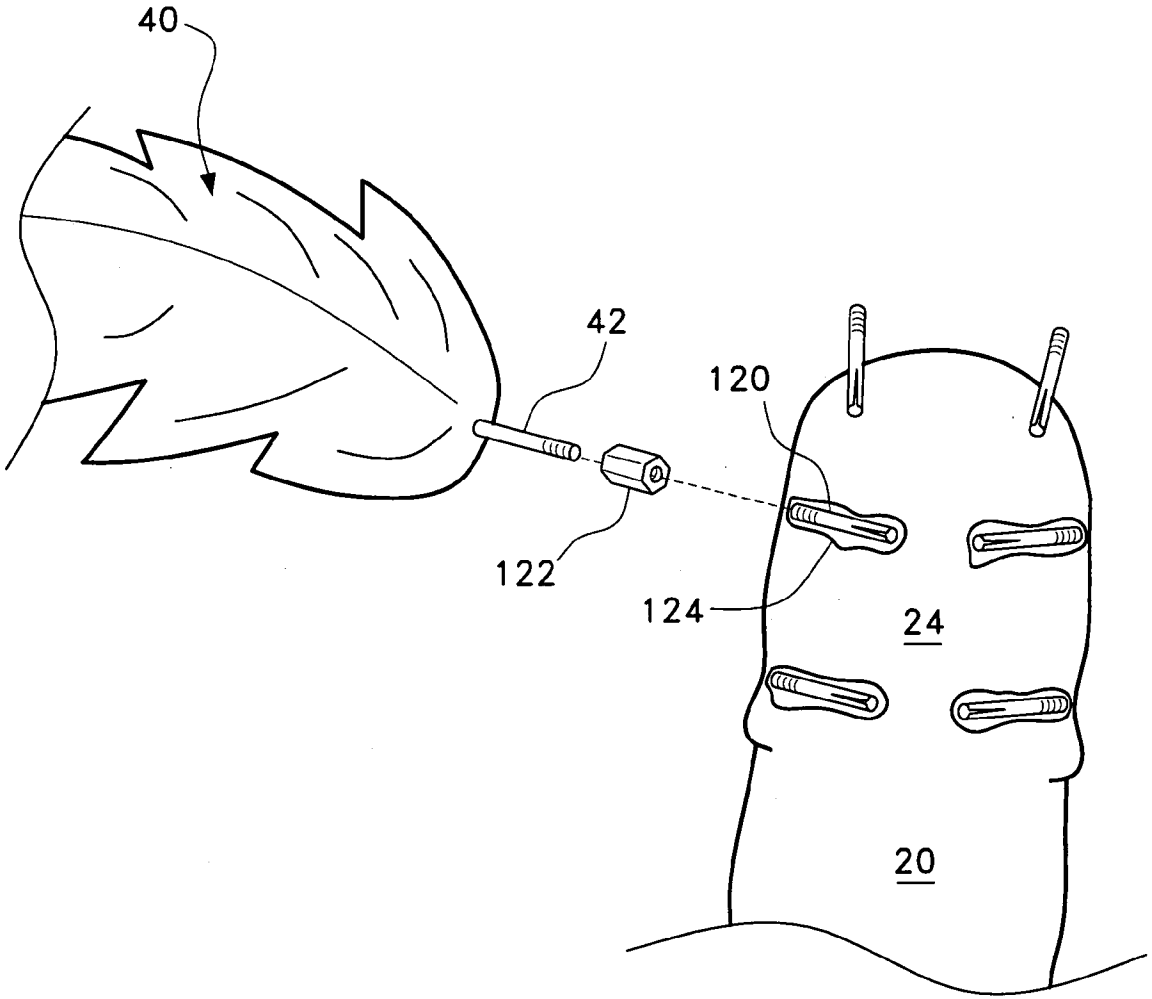
FIG. 4A, FIG. 4B, FIG. 4C and FIG. 4D are exploded side perspective views of the palm leaf attachment, artificial coconut light attachment, the frond attachment and the plastic leave attachment of the portable palm tree in a planter.

FIG. 4A illustrates how the plurality of sheet metal leaves 40 are attached to the distal end 24 of the core stem 20. Each of the plurality of sheet metal leaves 40 is attached to the distal end 24 of the core stem 20 with an anchor bolt 120, a barrel nut 122 and epoxy adhesive 124. There are 9–12 leaves in the plurality of sheet metal leaves 40 for the portable palm tree in a planter 10. The plurality of sheet metal leaves 40 are made of galvanized sheet metal and bronze welds (not shown) and are also treated with a red oxide metal primer. They are accompanied by a plurality of dead fronds 130 and a plurality of plastic leaves 134 that are also attached to the distal end 24 of the core stem 20 using a strip of sheet metal and brads 132 that can hide the anchor bolts 120, the barrel nuts 122 and epoxy adhesive 124.

Figure 4B:
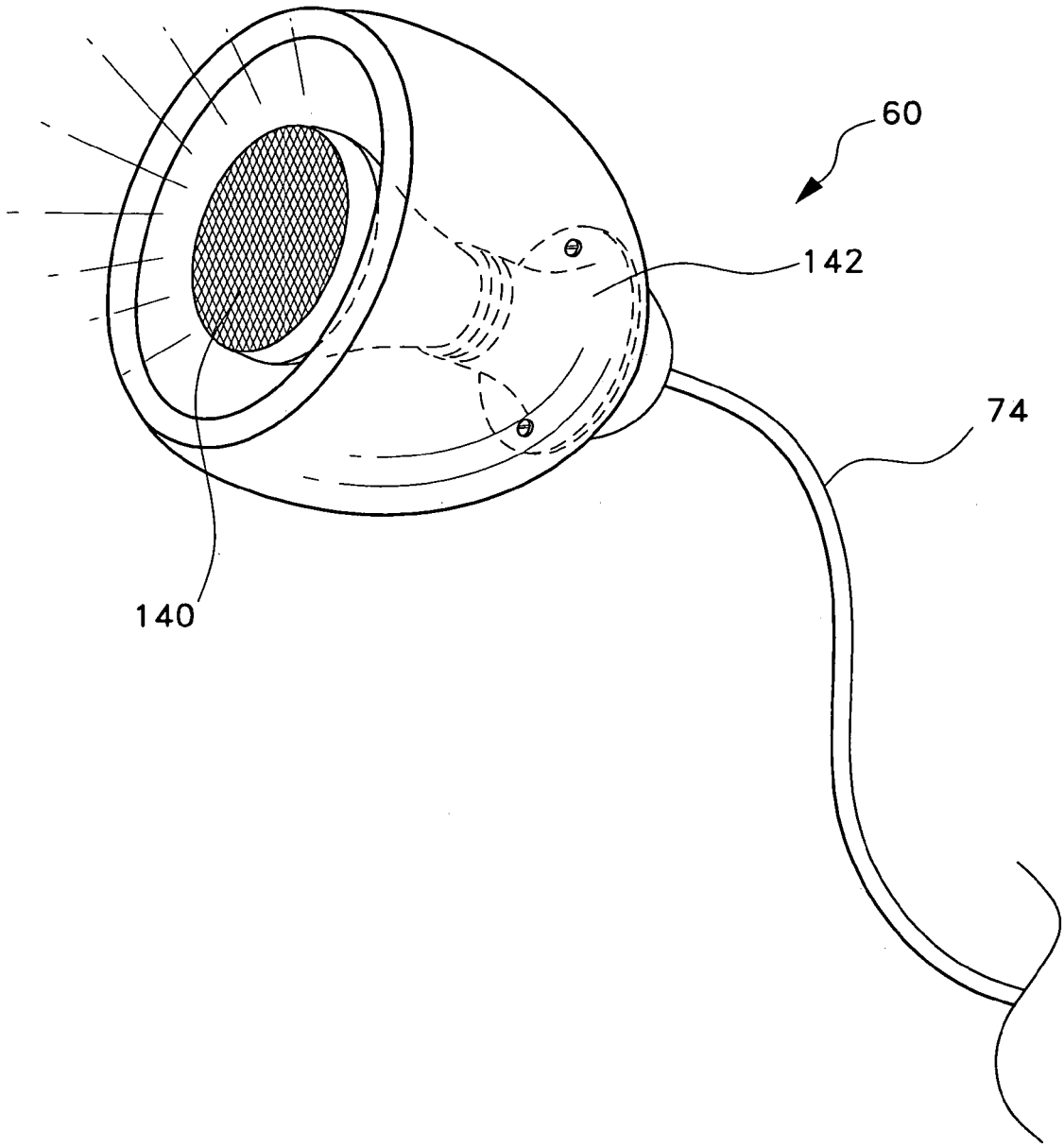

FIG. 4B depicts the plurality of artificial coconut lights 60. A light bulb 140 and a standard socket and base 142 are placed in an empty coconut shell, which are all powered by the conduit 74 leading up to the plurality of coconut lights 60 through the core stem 20. Note that only the first embodiment of the portable palm tree in a planter 10 has the plurality of artificial coconut lights 60 on the distal end 24 of the core stem 20.

Figure 4C:
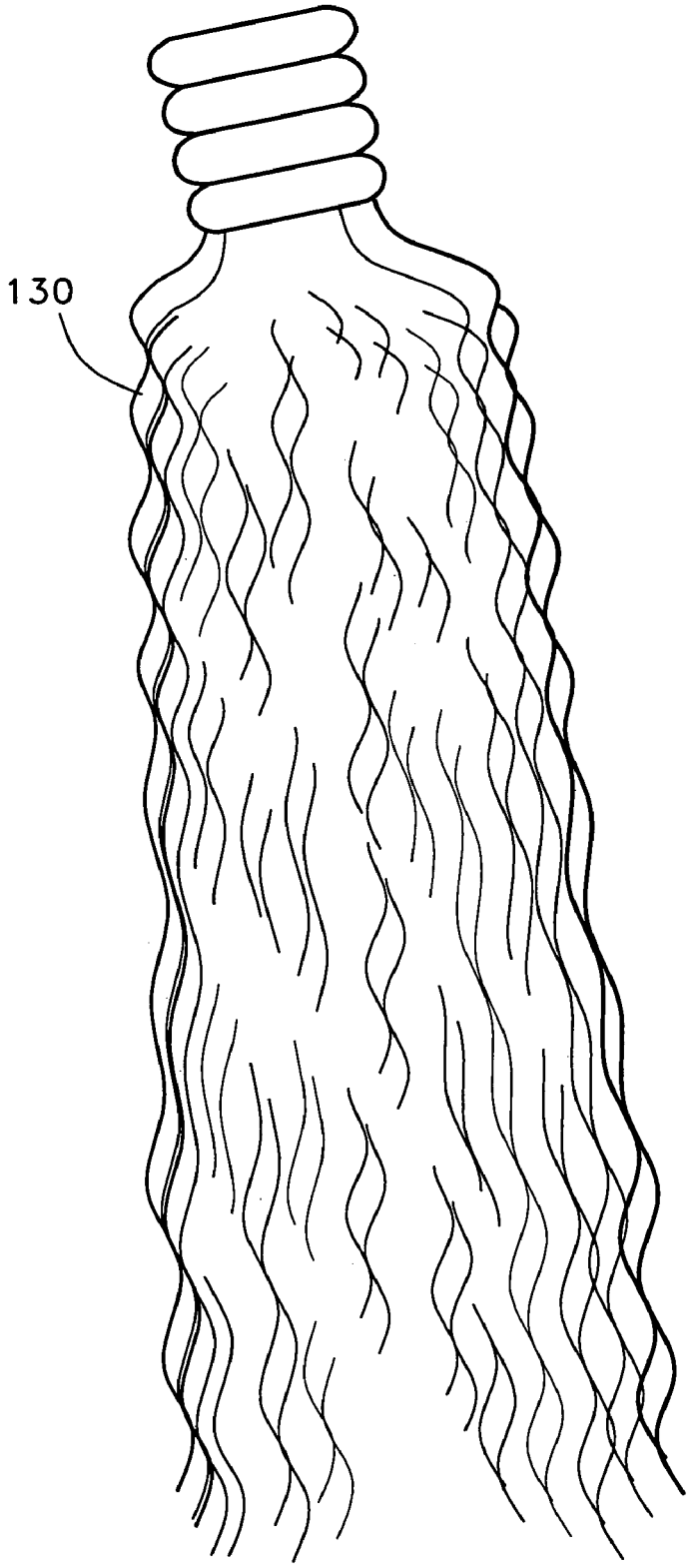
Figure 4D:
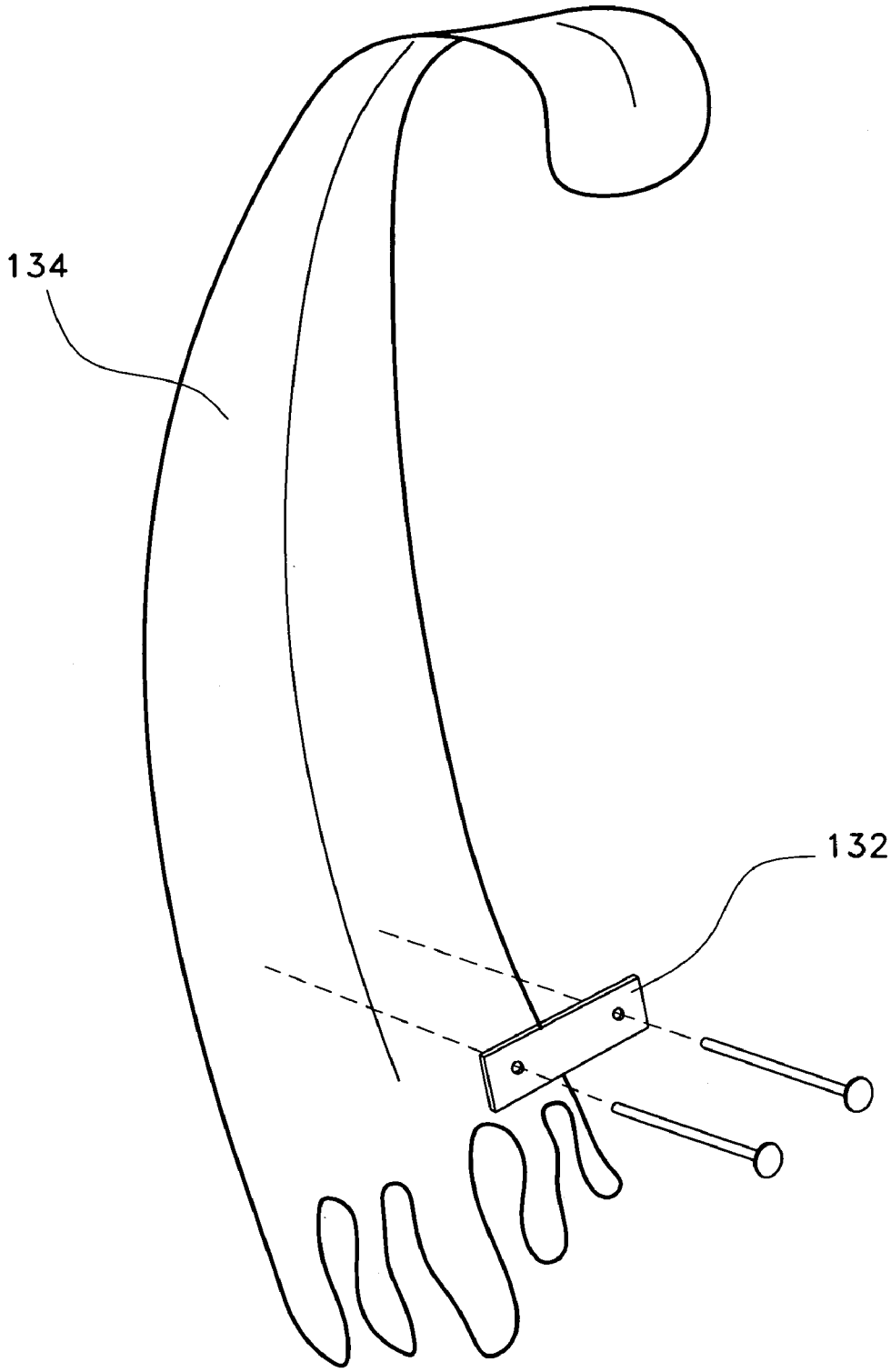

FIG. 4C and FIG. 4D depict the plurality of dead fronds 130 and the plurality of plastic leaves 134 that are provided at the distal end 24 of the core stem 20 along with the plurality of sheet metal leaves 40. The plurality of dead fronds 130 are adhered to the distal end 24 of the core stem 20 with glue or adhesive (not shown) and cover the threaded stem 42, anchor bolts 120 and barrel nuts 122. The plurality of plastic leaves 134 are similarly attached to the distal end 24 of the core stem 20 with brads and a strip of sheet metal 132.

Use and assembly of the portable palm tree in a planter 10 is straightforward. There are 9–12 palm leaves in the plurality of leaves 40 that are made of galvanized sheet metal, while there are several dead fronds 130 and a plurality of plastic leaves 134 made from plastic and unwound nylon rope. The proximal end 22 of the core stem 20 can be slid into the flange 52, which is welded to the steel base plate 50, and can be further secured with a metal drive bolt 80 and cotter pin 82. The base plate 50 is also provided with an aperture 92 in each corner of the base plate 50 that can accommodate a base corner anchor 90 that anchors the planter box 30 to the ground.

The first embodiment of the portable palm tree in a planter 10 has a core stem 20 that has conduit 74 from the electric cord 70 to the distal end 24 of the core stem 20. This arrangement provides electricity to the plurality of artificial coconut lights 60 placed with the plurality of sheet metal leaves 40 and the plurality of dead fronds 130 and the plurality of plastic leaves 134 at the distal end 24 of the core stem 20. The first embodiment of the portable palm tree in a planter 10 has the plurality of artificial coconut lights 60 disposed on the distal end 24 of the core stem 20 to provide light for the portable palm tree in a planter 10. There is also a second embodiment of the portable palm tree in a planter where a plurality of artificial coconut lights 60 are placed on top of the planter box 30 adjacent to the core stem 20. The second embodiment of the portable palm tree in a planter is otherwise the same as the first embodiment of the portable palm tree in a planter 10 except for the placement of the plurality of artificial coconut lights 60.

Both embodiments of the portable palm tree in a planter 10 can be used inside or outside and the planter box 30 can also be used to hold beverages. Both embodiments of the portable palm tree in a planter 10 are weather resistant, durable and maintenance free. Both embodiments of the portable palm tree in a planter 10 also weigh approximately 80 pounds each.

It is to be understood that the present invention is not limited to the embodiments described above, but encompasses any and all embodiments within the scope of the following claims.

I claim:

1. A portable palm tree in a planter, comprising:

a core stem with a proximal end and a distal end to provide structure for the portable palm tree in the planter;

a planter box with a bottom, to receive and hold the core stem in an upright position;

a plurality of sheet metal leaves each with a threaded stem attached to the core stem;

a base disposed within the bottom of the planter box with a flange to receive the proximal end of the core stem;

a plurality of artificial coconut lights to illuminate the portable palm tree in the planter; and an electrical cord and plug to provide power from a power source to the plurality of coconut lights;

wherein the planter box is provided with a rope and wooden handle to make it easier to carry the planter box.

2. The portable palm tree in a planter according to claim 1, wherein the core stem is made of pressure treated wood.

3. The portable palm tree in a planter according to claim 1, wherein the planter box is held together with a plurality of straps and crimps wrapped around the planter box.

4. The portable palm tree in a planter according to claim 1, wherein each of the plurality of sheet metal leaves is attached to the distal end of the core stem.

5. The portable palm tree in a planter according to claim 1, wherein a plurality of dead fronds are attached to the distal end of the core stem.

6. The portable palm tree in a planter according to claim 1, wherein a drive bolt and a cotter pin secure the proximal end of the core stem within the flange.

7. The portable palm tree in a planter according to claim 1, wherein corner anchor bolts are provided to secure the base to the bottom of the planter box.

8. The portable palm tree in a planter according to claim 7, wherein corner anchor bolts run through the base and the bottom of the planter box to secure the planter box to a floor and ground surface.

9. The portable palm tree in a planter according to claim 1, wherein the plurality of artificial coconut lights are disposed on the distal end of the core stem to provide light for the portable palm tree in the planter.

10. The portable palm tree in a planter according to claim 9, wherein the plurality of artificial coconut lights are disposed on top of the planter box adjacent to the core stem.

11. A portable palm tree in a planter, comprising:

a core stem with a proximal end and a distal end to provide structure for the portable palm tree in the planter;

a planter box with a bottom, to receive and hold the core stem in an upright position;

a plurality of sheet metal leaves each with a threaded stem attached to the core stem;

a base disposed within the bottom of the planter box with a flange to receive the proximal end of the core stem;

a plurality of artificial coconut lights to illuminate the portable palm tree in the planter; and an electrical cord and plug to provide power from a power source to the plurality of coconut lights;

wherein the planter box is held together with a plurality of straps and crimps wrapped around the planter box.

12. The portable palm tree in a planter according to claim 11, wherein each of the plurality of sheet metal leaves is attached to the distal end of the core stem.

13. The portable palm tree in a planter according to claim 11, wherein a plurality of dead fronds are attached to the distal end of the core stem.

14. The portable palm tree in a planter according to claim 11, wherein a drive bolt and a cotter pin secure the proximal end of the core stem within the flange.

15. The portable palm tree in a planter according to claim 11, wherein corner anchor bolts are provided to secure the base to the bottom of the planter box.

16. The portable palm tree in a planter according to claim 15, wherein corner anchor bolts run through the base and the bottom of the planter box to secure the planter box to a floor and ground surface.

17. The portable palm tree in a planter according to claim 11, wherein the plurality of artificial coconut lights are disposed on the distal end of the core stem to provide light for the portable palm tree in the planter.

18. The portable palm tree in a planter according to claim 17, wherein the plurality of artificial coconut lights are disposed on top of the planter box adjacent to the core stem.

19. A portable palm tree in a planter, comprising:

a core stem with a proximal end and a distal end to provide structure for the portable palm tree in the planter;

a planter box with a bottom, to receive and hold the core stem in an upright position;

a plurality of sheet metal leaves each with a threaded stem attached to the core stem;

a base disposed within the bottom of the planter box with a flange to receive the proximal end of the core stem;

a plurality of artificial coconut lights to illuminate the portable palm tree in the planter; and an electrical cord and plug to provide power from a power source to the plurality of coconut lights;

wherein a drive bolt and a cotter pin secure the proximal end of the core stem within the flange.

* * * * *